US011656569B2

(12) United States Patent
Kusukawa

(10) Patent No.: US 11,656,569 B2
(45) Date of Patent: May 23, 2023

(54) IMAGE FORMING APPARATUS RESTRICTING TRAJECTORY OF ELECTRICAL BOX DURING ASSEMBLY

(71) Applicant: KYOCERA DOCUMENT SOLUTIONS INC., Osaka (JP)

(72) Inventor: Takashi Kusukawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 17 days.

(21) Appl. No.: 17/599,803

(22) PCT Filed: Mar. 18, 2020

(86) PCT No.: PCT/JP2020/011953
§ 371 (c)(1),
(2) Date: Sep. 29, 2021

(87) PCT Pub. No.: WO2020/203290
PCT Pub. Date: Oct. 8, 2020

(65) Prior Publication Data

US 2022/0179351 A1 Jun. 9, 2022
US 2022/0179351 A1 Jun. 9, 2022

(30) Foreign Application Priority Data

Mar. 29, 2019 (JP) ..... JP2019-066759

(51) Int. Cl.
*G03G 15/00* (2006.01)

(52) U.S. Cl.
CPC ..... *G03G 15/80* (2013.01)

(58) Field of Classification Search
USPC ..... 399/90
See application file for complete search history.

(56) References Cited

U.S. PATENT DOCUMENTS 5,918,089 A 6/1999 Malinich et al.
2003/0156854 A1 8/2003 Sugita
(Continued)

FOREIGN PATENT DOCUMENTS

JP 2003-224371 8/2003
JP 2013-059909 4/2013
(Continued)

OTHER PUBLICATIONS

International Search Report dated Jun. 16, 2020 in International (PCT) Application No. PCT/JP2020/011953.

*Primary Examiner* — Quana Grainger
(74) *Attorney, Agent, or Firm* — Alleman Hall Creasman & Tuttle LLP

(57) ABSTRACT

An image forming apparatus includes a frame side plate. A mounting surface of the frame side plate on which a first electrical board is mounted has a frame protruding plate. An electrical box has a box protruding plate overlapping a side surface of the frame protruding plate when assembling of the electrical box to the frame side plate is completed, and engaging portions for assembling protruding in a thickness direction from the box protruding plate. When the electrical box is assembled to the frame side plate, with the engaging portions for assembling in engagement with first engaged portions formed on a protruding side end of the frame protruding plate, the electrical box as a whole is turned around an axis parallel to an extending direction of the frame protruding plate with the engaged portions as a fulcrum, thereby restricting a trajectory of the electrical box during assembling.

5 Claims, 18 Drawing Sheets

(56) References Cited

U.S. PATENT DOCUMENTS

| | | | | |
|---|---|---|---|---|
| 2015/0378303 | A1 | 12/2015 | Ohata | |
| 2017/0060075 | A1 * | 3/2017 | Shimizu | G03G 15/80 |

FOREIGN PATENT DOCUMENTS

| | | |
|---|---|---|
| JP | 2016-012066 | 1/2016 |
| JP | 2017-069538 | 4/2017 |

* cited by examiner

IMAGE FORMING APPARATUS RESTRICTING TRAJECTORY OF ELECTRICAL BOX DURING ASSEMBLY

TECHNICAL FIELD

The present invention relates to an image forming apparatus.

BACKGROUND ART

An electrophotographic color image forming apparatus generally has four image forming units, which correspond to images of four different colors (cyan, magenta, yellow, and black), disposed in an image forming apparatus body thereof (for example, see Patent Literature 1).

The four image forming units each include a processing unit (e.g., a photosensitive drum unit, a developing unit, or the like) that performs an image formation process on a sheet. The four image forming units are disposed between a front frame and a rear frame of the image forming apparatus body. On the rear frame, a high voltage board that supplies high voltage to the processing units of the image forming units, and an engine board that drives a drive motor of a conveyance system and the like are mounted on the side opposite to the image forming unit side.

The rear frame usually has, in addition to the high voltage board and the engine board, a control board mounted thereon that performs control of image processing and control of display. A known structure for mounting the control board is configured such that the control board is housed by an electrical box and the electrical box is arranged to overlap the high voltage board and the engine board from the outer side.

CITATION LIST

Patent Literature

Patent Literature 1: Japanese Unexamined Patent Application Publication No. 2016-012066

SUMMARY OF INVENTION

Technical Problem

The above-described arrangement in which the electrical box overlaps the high voltage board and the engine board (first electrical board) allows the area of the rear frame (frame side plate) to be reduced and the control board (second electrical board) to be arranged with high space efficiency.

In this case, however, when an operator assembles the electrical box to the frame side plate, his/her field of view is obstructed by the electrical box, so that the operator is unable to visually recognize the position of the already assembled first electrical board. Because of this, during assembling of the electrical box, a part of the electrical box may accidentally contact the first electrical board and such a contact may damage the first board.

The present invention has been achieved in view of the aforementioned circumstances, and an object of the invention is to, in an image forming apparatus in which an electrical box housing a second electrical board is arranged to overlap a first electrical board, enable the electrical box to be assembled to a predetermined position without contacting the first electrical board.

Solution to Problem

An image forming apparatus according to the present invention includes an image forming apparatus body that houses an image forming unit, a first electrical board and a second electrical board that are disposed on a side opposite to the image forming unit side on a frame side plate provided on the image forming apparatus body, and an electrical box that houses the second electrical board and is arranged to overlap the first electrical board from an outer side of the image forming apparatus body.

A mounting surface of the frame side plate on which the first electrical board is mounted has a frame protruding plate provided thereon that is formed perpendicularly to the mounting surface and protrudes outward of the image forming apparatus body. The electrical box has a box protruding plate that overlaps a side surface of the frame protruding plate when assembling of the electrical box to the frame side plate is completed, and an engaging portion for assembling that protrudes in a thickness direction from the box protruding plate. The electrical box is configured such that, when assembling of the electrical box to the frame side plate is carried out, with the engaging portion for assembling in engagement with a first engaged portion formed on a protruding side end of the frame protruding plate, the electrical box as a whole is turned around an axis parallel to an extending direction of the frame protruding plate with the first engaged portion as a fulcrum to thereby restrict a trajectory of the electrical box during the assembling.

Advantageous Effects of Invention

According to the present invention, in an image forming apparatus in which an electrical box housing a second electrical board is arranged to overlap a first electrical board, it is possible to assemble the electrical box to a predetermined position without the electrical box contacting the first electrical board.

DESCRIPTION OF EMBODIMENTS

Hereinafter, an embodiment of the present invention will be described in detail on the basis of the drawings. It should be noted that the invention is not limited to the embodiment described below.

Embodiment

Figure 1:
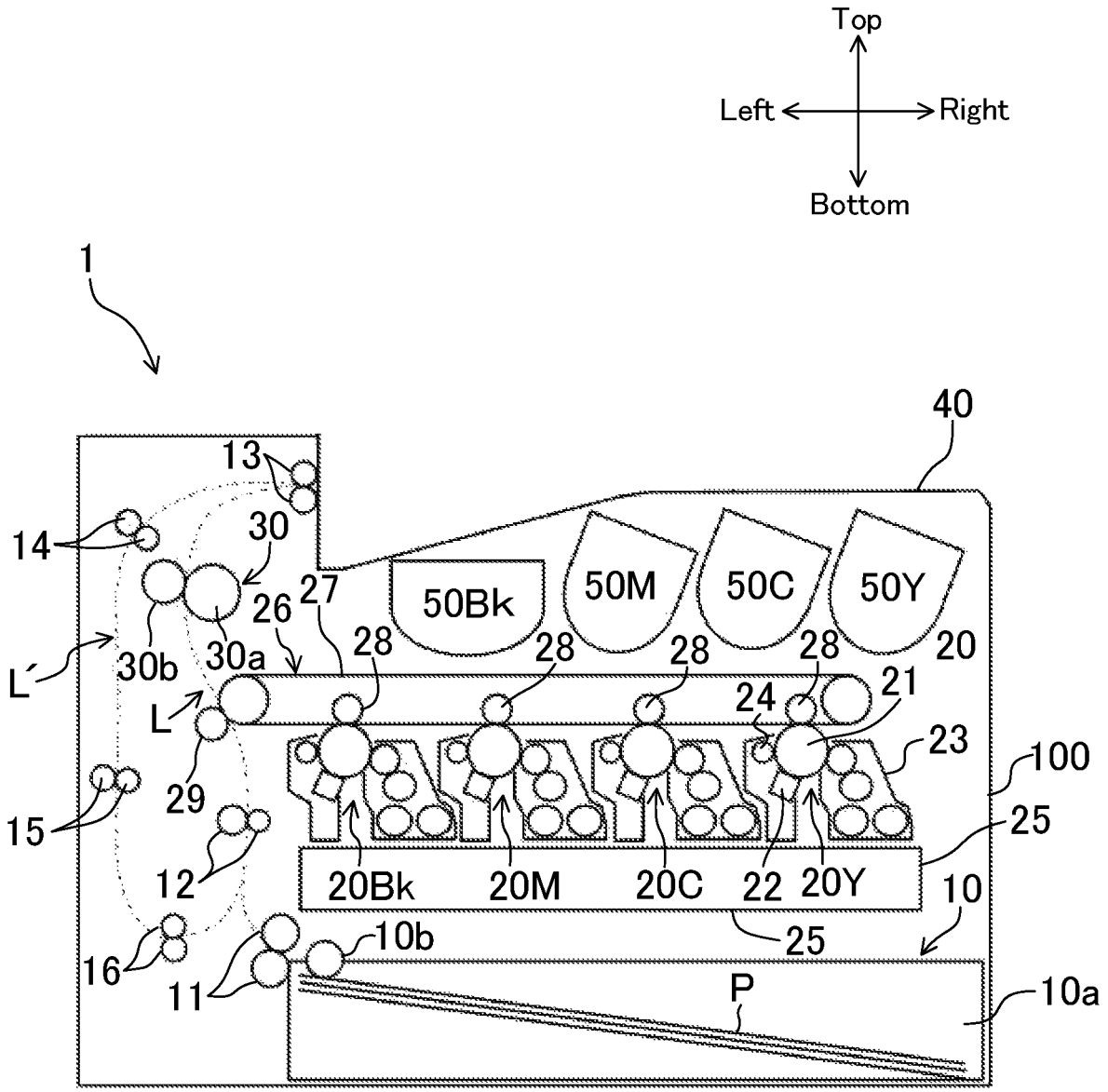
FIG. 1 is a schematic overall view of an image forming apparatus in an embodiment.

FIG. 1 shows an image forming apparatus 1 in this embodiment. The image forming apparatus 1 is composed of, for example, a color laser printer (hereinafter, simply referred to as "printer") 1.

The image forming apparatus 1 has an image forming apparatus body 100. The image forming apparatus body 100 has a sheet feeding unit 10, an image forming unit 20, and a fixing unit 30 therein, and has a sheet discharging unit 40 on a top surface thereof. A sheet conveyance path L that leads from the sheet feeding unit 10 to the sheet discharging unit 40 has a plurality of conveyance roller pairs 11 to 13 arranged thereon that nip and covey a paper sheet P. A reverse conveyance path L' is connected to the sheet conveyance path L. The reverse conveyance path L' branches off from a downstream side of the sheet conveyance path L and connects to an upstream side of the sheet conveyance path L. The reverse conveyance path L' has conveyance roller pairs 14 to 16 arranged thereon.

The sheet feeding unit 10 is arranged below the image forming unit 20. The sheet feeding unit 10 includes a sheet feed cassette 10*a* that contains paper sheets P, and a pick-up roller 10*b* that picks up paper sheets P from the sheet feed cassette 10*a* and feeds the paper sheets P out of the cassette. The paper sheets P fed out of the sheet feed cassette 10*a* are supplied to the image forming unit 20 through the conveyance roller pair 11.

In the image forming unit 20, imaging units 20Bk, 20M, 20C, and 20Y that respectively form toner images corresponding to black, magenta, cyan, and yellow are arranged in one line. Each imaging unit 20Bk, 20M, 20C, 20Y includes a photosensitive drum 21, a charging device 22, a developing device 23, and a cleaning device 24. In the figures, reference numerals 21 to 24 are provided only for the imaging unit 20Y for yellow and are omitted with respect to the other units 20Bk, 20M, and 20C. Below the imaging units 20Bk, 20M, 20C, and 20Y, an exposure device 25 is arranged that radiates a laser beam to the surface of each photosensitive drum 21. Above the imaging units 20Bk, 20M, 20C, and 20Y, an intermediate transferring unit 26 is arranged.

The intermediate transferring unit 26 includes an intermediate transfer belt 27, four primary transfer rollers 28, and a secondary transfer roller 29. The intermediate transfer belt 27 rotates in contact with the photosensitive drums 21. The four primary transfer rollers 28 are arranged inside the intermediate transfer belt 27 such that they sandwich the intermediate transfer belt 27 in cooperation with the photosensitive drums 21. The secondary transfer roller 29 is arranged on the downstream side of the imaging unit 20Bk such that the secondary transfer roller 29 is in contact with the surface of the intermediate transfer belt 27. Above the intermediate transferring unit 26, tonner containers 50Bk, 50M, 50C, and 50Y are arranged that respectively contain toners of the colors to be supplied to the developing units 23 of the imaging units 20Bk, 20M, 20C, and 20Y.

In the image forming unit 20, the exposure device 25 radiates a laser beam based on predetermined image data to the surface of each photosensitive drum 21 to form an electrostatic latent image on the surface of each photosensitive drum 21, and the formed electrostatic latent image is developed by the developing device 23, whereby a toner image of each color is formed on the surface of each photosensitive drum 21. The toner image of each color formed the surface of each photosensitive drum 21 is transferred onto the surface of the intermediate transfer belt 27 by each primary transfer roller 28 such that they are superimposed one upon another. The toner images transferred on the intermediate transfer belt 27 are transferred onto a paper sheet P, which is supplied from the sheet feeding unit 10, by the secondary transfer roller 29. The paper sheet P subjected to the transfer is supplied to the fixing unit 30. In the fixing unit 30, the paper sheet P supplied from the image forming unit 20 is pressed between a fixing roller 30*a* and a pressure roller 30*b*, whereby the toner images are fixed on the paper sheet P. The paper sheet P subjected to the fixing of the toner images in the fixing unit 30 is fed out to the downstream side by the rollers 30*a*, 30*b*. The paper sheet P fed out of the fixing unit 30 is discharged to the sheet discharging unit 40 through the transfer roller pairs 12, 13. In the case of forming toner images on both surfaces of a paper sheet P, the paper sheet P is switched back and conveyed to the reverse conveyance path L' by the transfer roller pair 13.

The image forming apparatus body 100 has a front frame (not illustrated) and a rear frame 101 (an example of the frame side plate, see FIG. 2) made of sheet metal that are opposed to each other in the front-rear direction. The imaging units 20Bk, 20M, 20C, and 20Y are disposed between the front frame and the rear frame 101.

[Arrangement of Boards]

Figure 2:
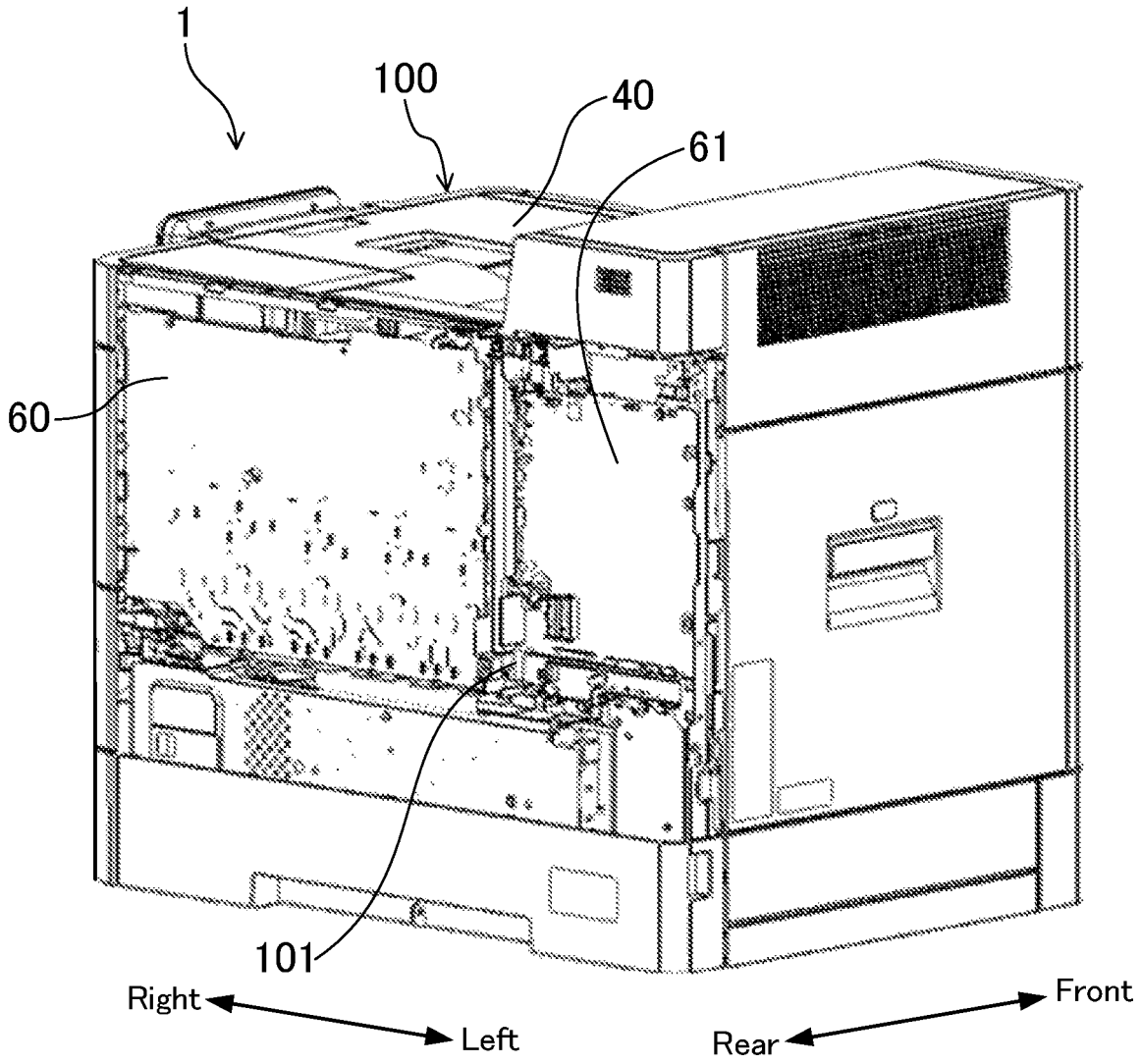
FIG. 2 is a perspective view of the image forming apparatus with an electrical box detached from a rear frame, as viewed obliquely from the rear left side.
Figure 3:
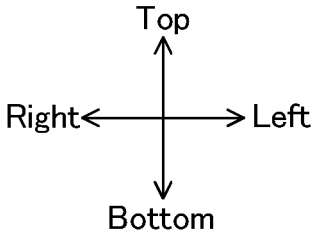
FIG. 3 is rear view of the image forming apparatus with the electrical box detached from the rear frame.
Figure 3:
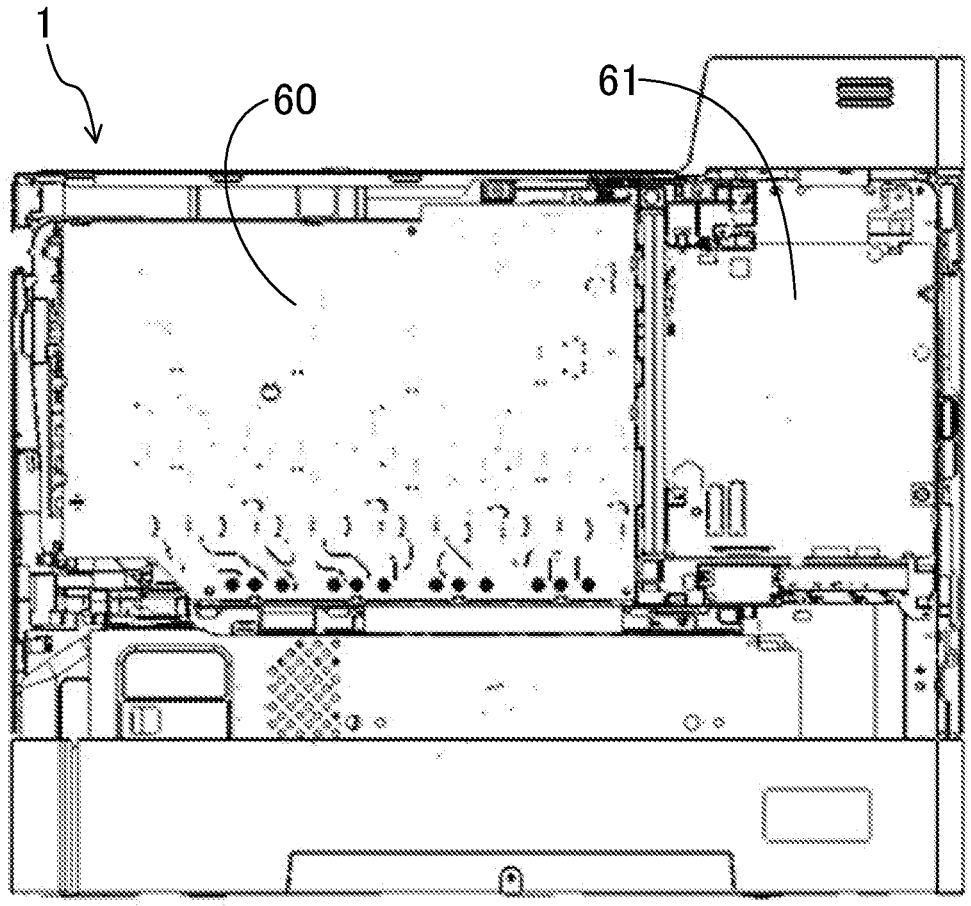
Figure 4:
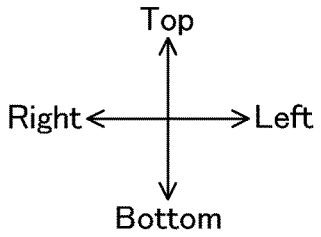
FIG. 4 is a rear view of the upper half of the image forming apparatus with the electrical box mounted on the rear frame.
Figure 4:
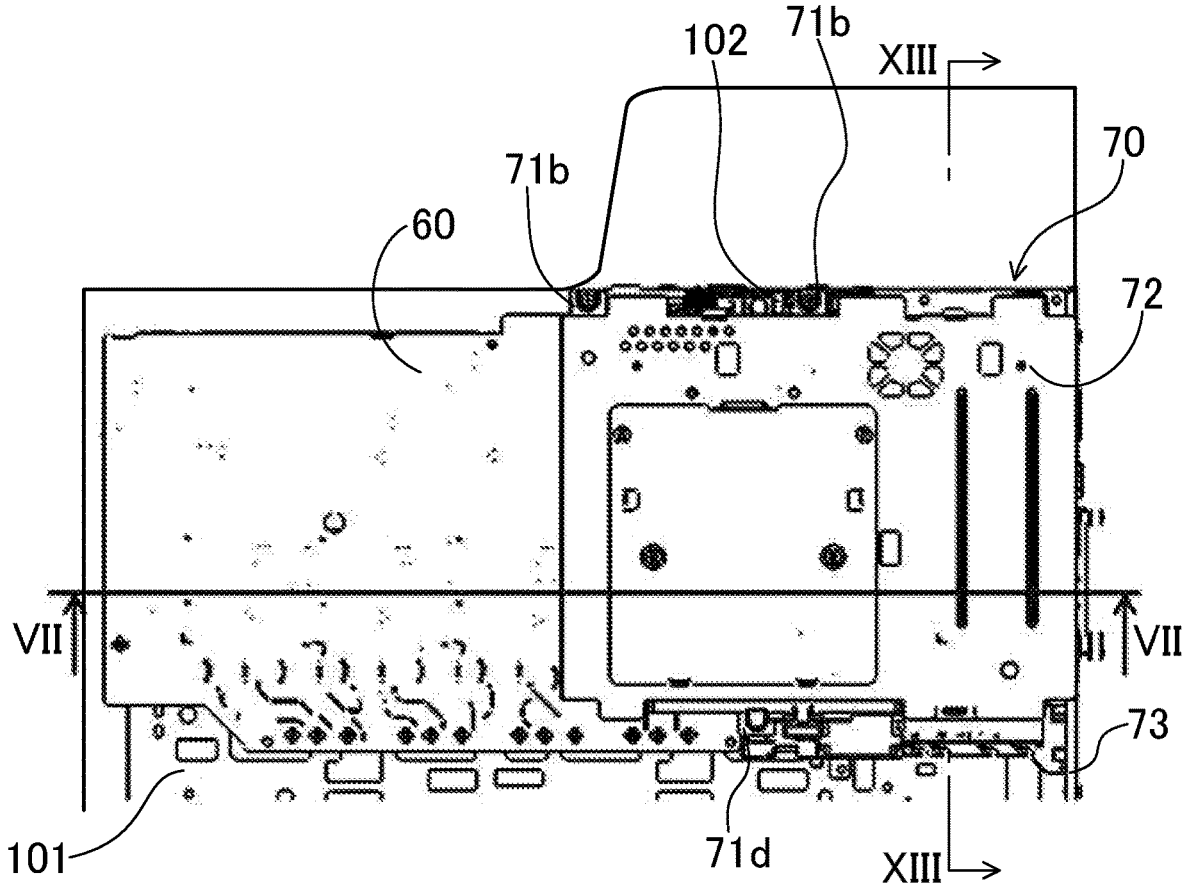

On a rear surface of the rear frame 101, as shown in FIGS. 2 and 3, a high voltage board 60 is mounted on a portion corresponding to the imaging units 20Bk, 20M, 20C, and 20Y, and an engine board 61 is mounted on a portion corresponding to upper ends of the sheet conveyance path L and reverse conveyance path L'. The high voltage board 60 supplies high voltage to the developing units 23 and the photosensitive drums 21. The engine board 61 controls operation of a drive motor of the conveyance system and a drive motor of a cooling fan. Behind (i.e., on the rear side of) the high voltage board 60 and the engine board 61, a control board 62 and an electrical box 70 (not illustrated in FIGS. 2 and 3) housing the control board 62 are arranged. The control board 62 performs control of image processing and control of display. The high voltage board 60 and the engine board 61 correspond to the first electrical board, while the control board 62 corresponds to the second electrical board.

[Configuration of Electrical Box]

Figure 5:
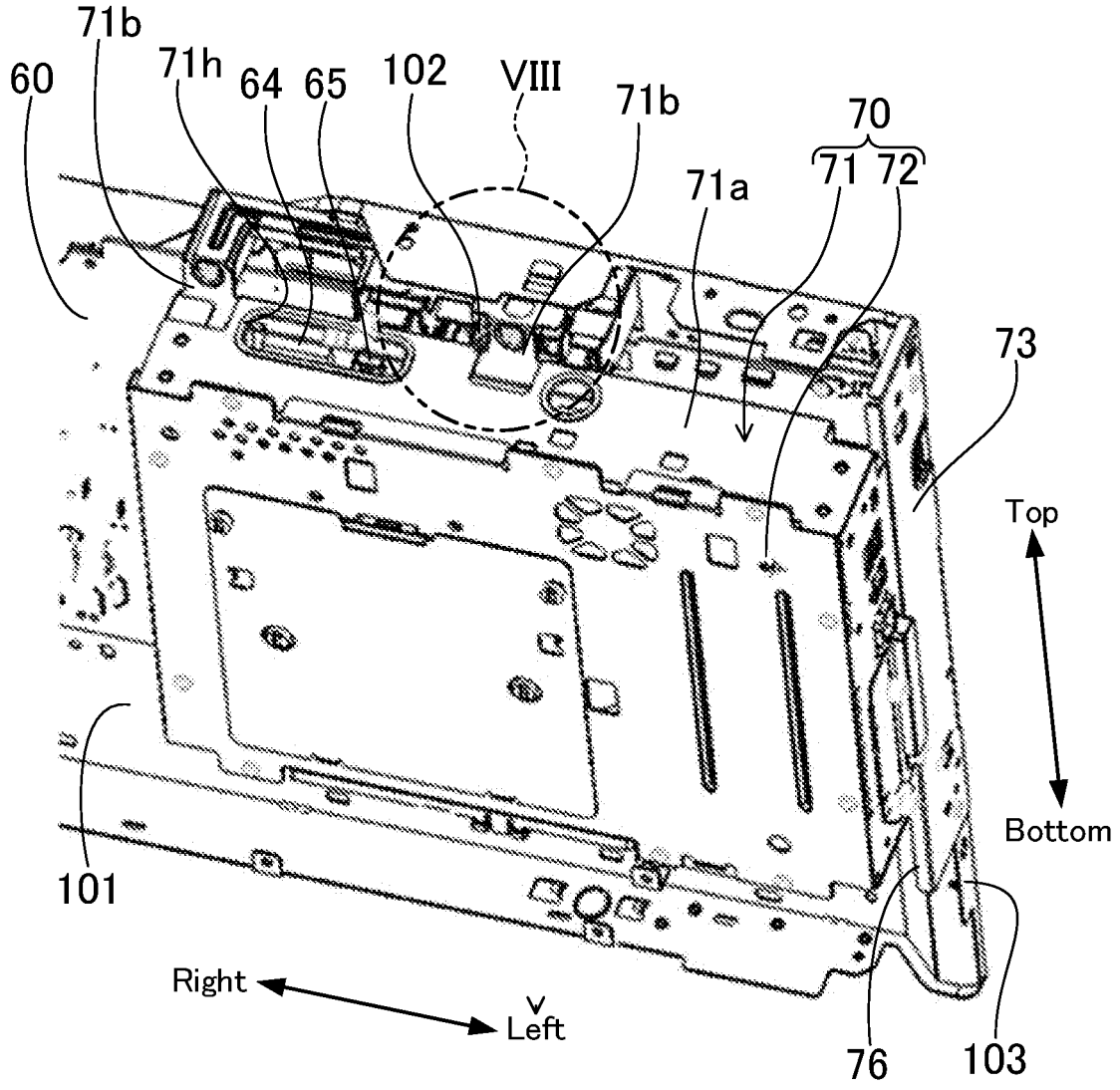
FIG. 5 is a perspective view of the upper half of the image forming apparatus with the electrical box mounted on the rear frame, as viewed obliquely from the upper rear left side.
Figure 6:
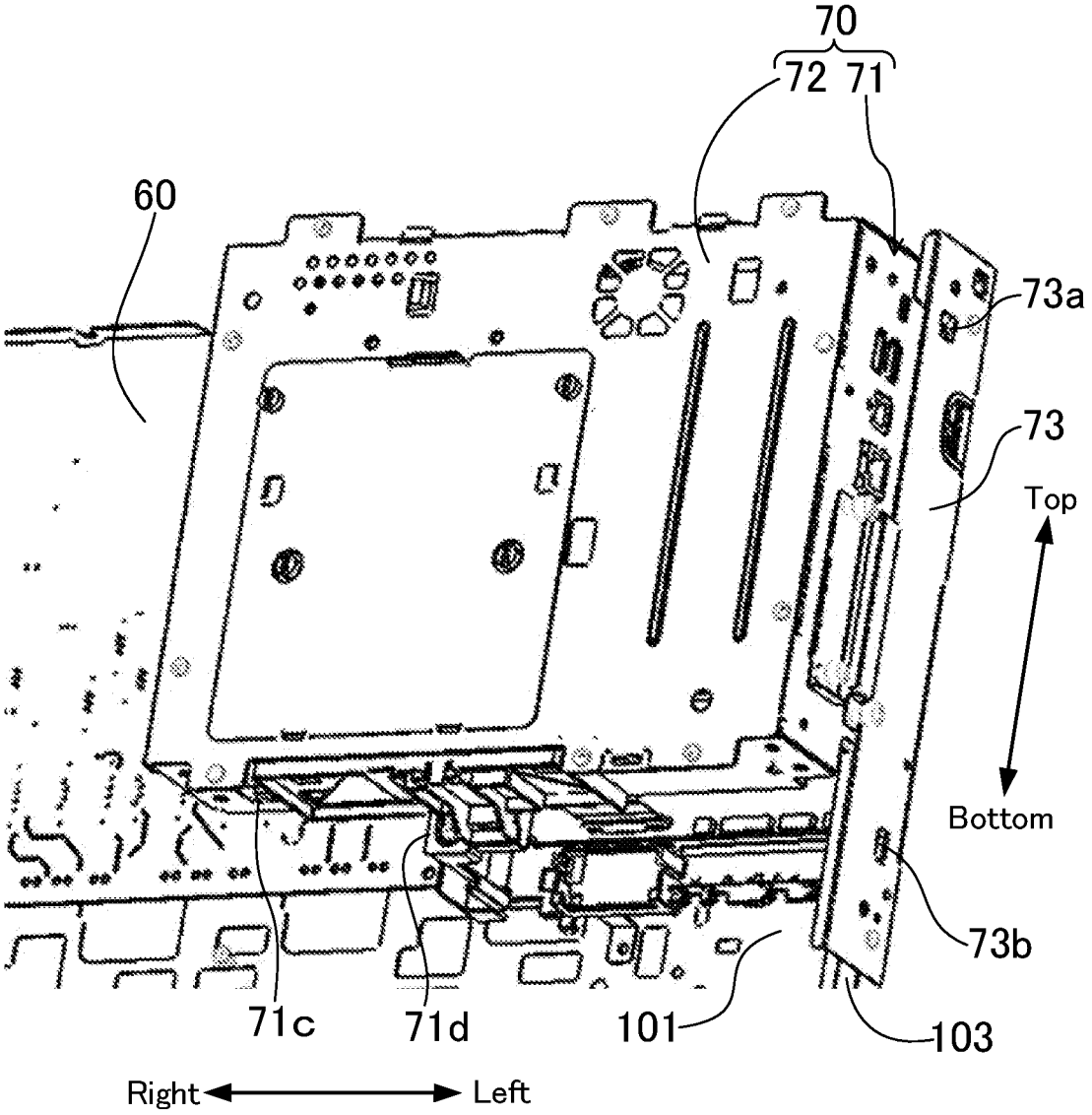
FIG. 6 is a perspective view of the upper half of the image forming apparatus with the electrical box mounted on the rear frame, as viewed obliquely from the lower rear left side.
Figure 7:
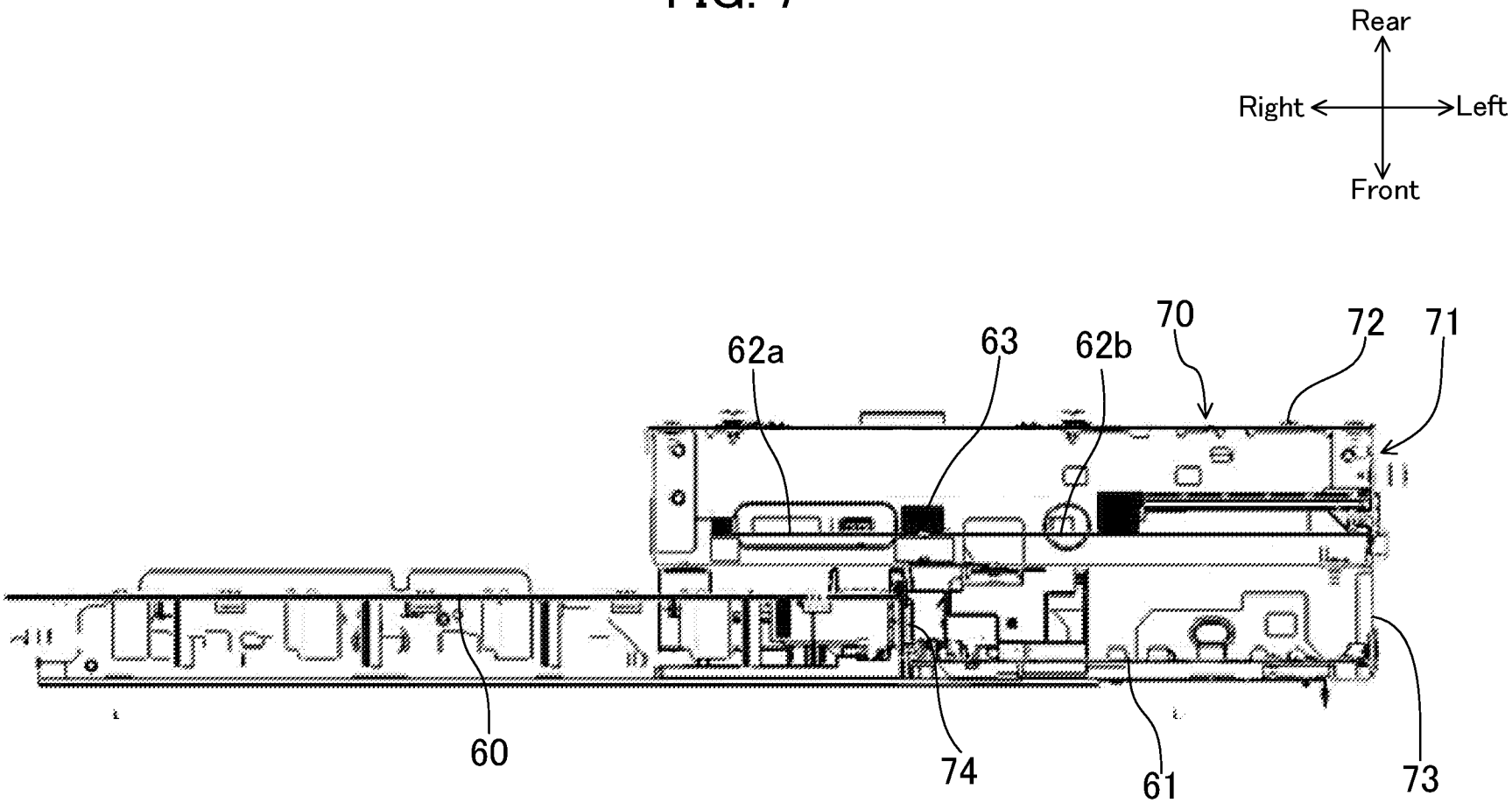
FIG. 7 is a sectional view taken along the line VII-VII in FIG. 4.

FIGS. 4 to 7 show a state where the electrical box 70 is mounted on the rear frame 101. The electrical box 70 has a box body 71 and a lid member 72 (an example of the top plate) and, as viewed as a whole, has a rectangular box shape extending in the right-left direction. The electrical box 70 is composed of, for example, sheet metal members. As shown in FIG. 7, the electrical box 70 is arranged to cross a boundary position between the high voltage board 60 and the engine board 61 and overlap both the boards 60, 61 from the rear side of the boards 60, 61 (an example of the outer side of the image forming apparatus body).

The box body 71 is composed of a flat and bottomed box-shaped member that is formed such that a base plate 71*e* as a bottom plate of the box body 71 faces the rear frame 101. The lid member 72 removably closes the open side (rear side) of the box body 71. As shown in FIG. 5, an upper side plate 71*a* of the box body 71 has two brackets for fixation 71*b* (an example of the engaging portion for temporary holding) thereon that are formed to protrude therefrom. As shown in FIG. 6, a lower side plate 71*c* of the box body 71 has one bracket for fixation 71*d* thereon that is formed to protrude therefrom. The box body 71 is fixed to the rear frame 101 at three points by bolts 75 (see FIG. 8) penetrating through the brackets for fixation 71*b*, 71*d*.

Figure 8:
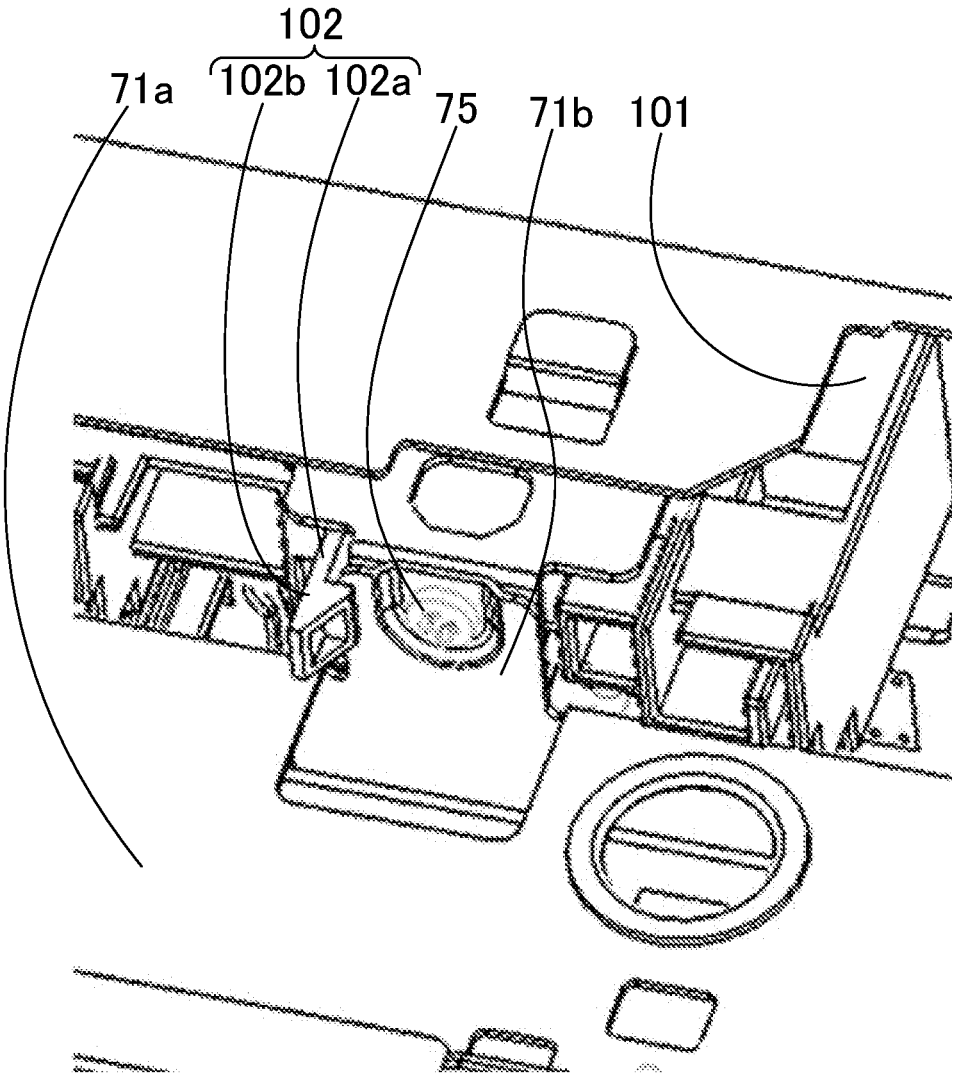
FIG. 8 is an enlarged view of the circled area VIII in FIG. 5.

As shown in FIG. 8, one of the two brackets for fixation 71*b* formed on the upper side plate 71*a* engages with an engagement hook 102. The engagement hook 102 has a flexible plate part 102*a* connected perpendicularly to a board mounting surface of the rear frame 101, and a triangular prism-shaped claw part 102*b* formed on a distal end of the flexible plate part 102*a*. When the electrical box 70 is assembled to the rear frame 101, the oblique face of the claw part 102*b* is pushed by the bracket for fixation 71*b* and the flexible plate part 102*a* is thereby deflected. Once the bracket for fixation 71*b* completely passes through the oblique face of the claw part 102*b*, the flexible plate part 102*a* returns to its original state by virtue of its own restoring force, so that the claw part 102*b* engages the bracket for fixation 71*b*. Thus, the bracket for fixation 71*b* functions as the engaging portion for temporary holding.

Figure 9:
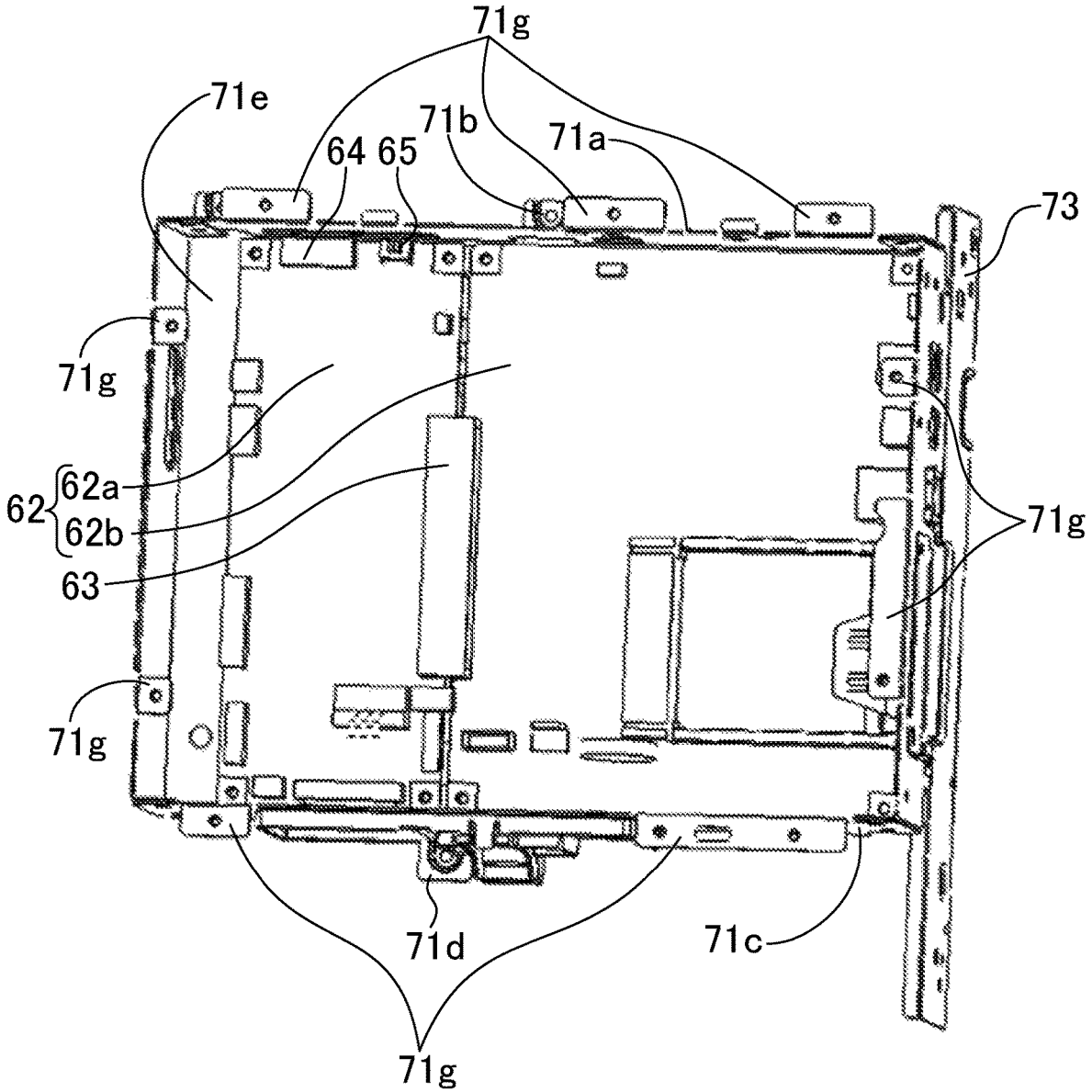
FIG. 9 is a perspective view of the electrical box with a lid member removed therefrom.

FIG. 9 shows a state where the lid member 72 is removed from the box body 71 of the electrical box 70. The box body 71 has bent flanges 71*g* formed on an open side edge thereof, which are used to fix the lid member 72 with screws.

The control board 62 is fixed to the base plate 71*e* inside the box body 71. The control board 62 consists of a first board part 62*a* and a second board part 62*b* that are adjacently arranged side by side, and a connection part 63 that connects the board parts 62*a* and 62*b*. The first board part 62*a* has two connectors 64 and 65 at an upper end thereof, which have predetermined communication standards.

Figure 10:
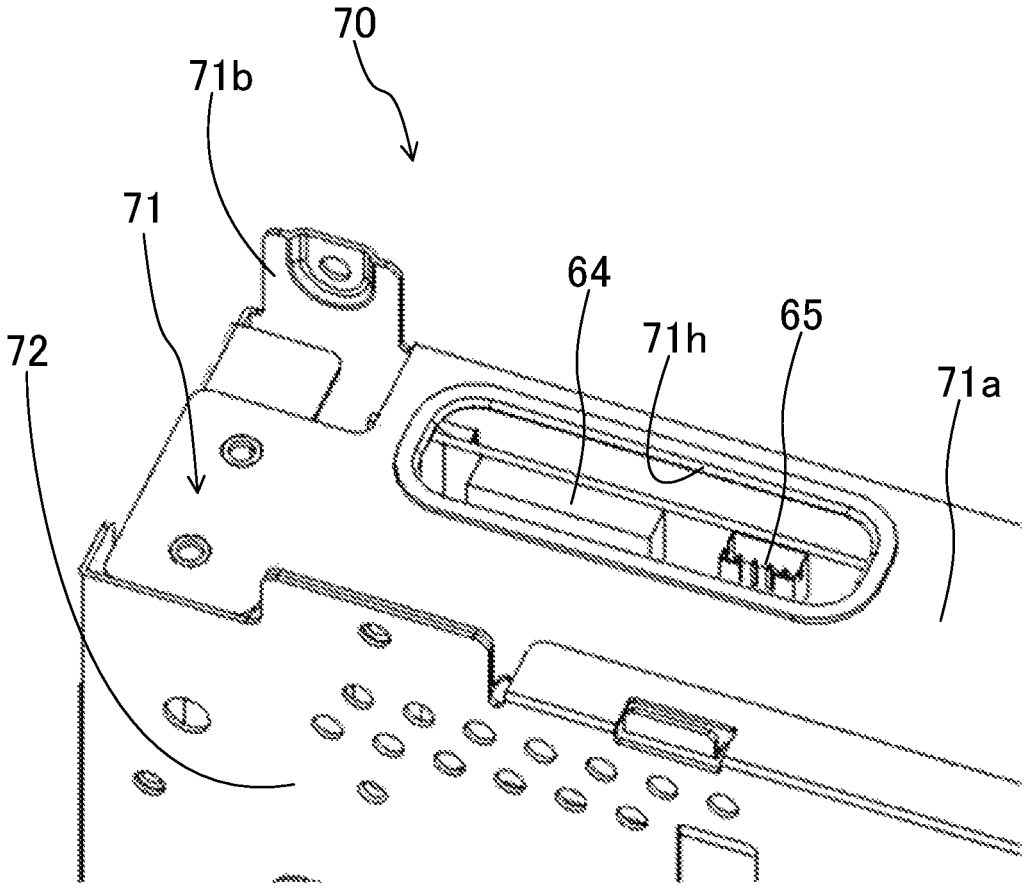
FIG. 10 is an enlarged perspective view of the vicinity of an opening formed in an upper side plate of the electrical box.

As shown in FIG. 10, the upper side plate 71*a* of the box body 71 has an opening 71*h* formed therein for exposing the two connectors 64, 65 to the outside. The opening 71*h* is formed in a slot shape extending in the right-left direction. Mating connectors (not illustrated) fitting with the two connectors 64, 65 are to be removably connected to the connectors 64, 65 in the vertical direction (i.e., a direction perpendicular to the upper side plate 71*a*) through the opening 71*h*.

[Configuration of Box Protruding Plate]

Figure 11:
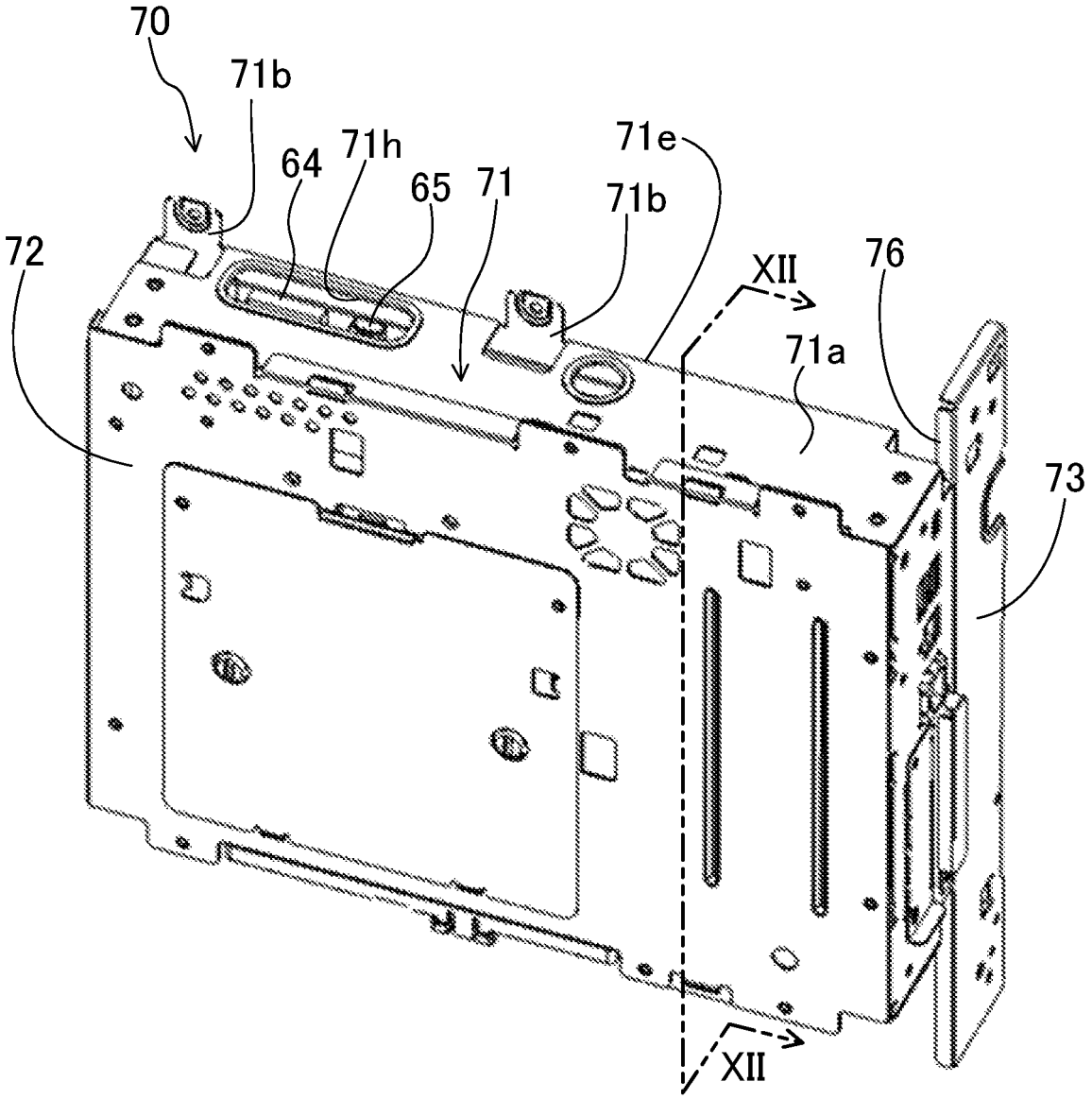
FIG. 11 is a perspective view of the electrical box as viewed from the lid member side.
Figure 12:
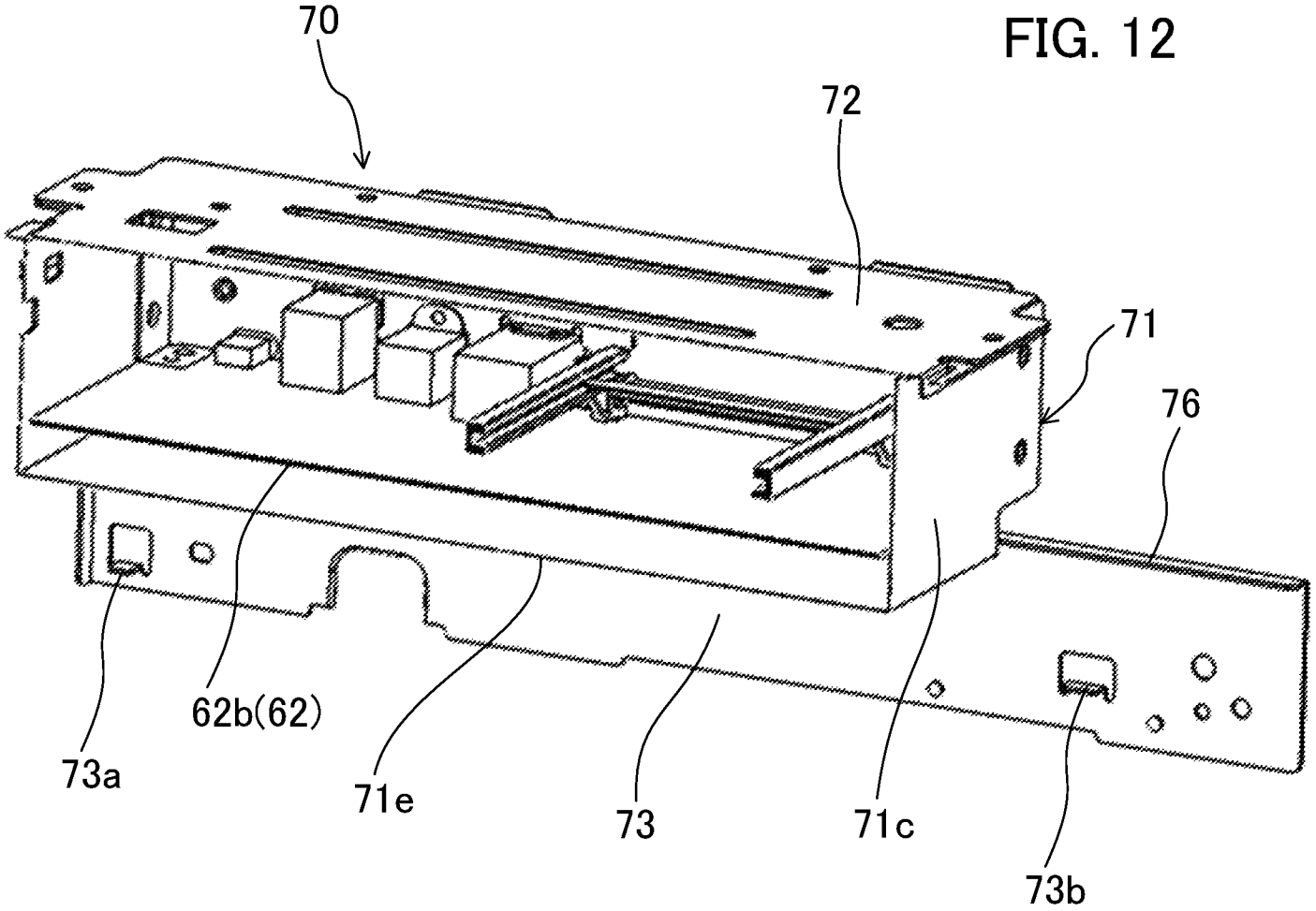
FIG. 12 is a cut model taken along the line XII-XII in FIG. 11.

As shown in FIGS. 11 and 12, a box protruding plate 73 is connected to one side end of the box body 71 in the right-left direction. The box protruding plate 73 protrudes to the rear frame 101 side with respect to the base plate 71*e* of the box body 71 when the electrical box 70 has been assembled to the rear frame 101. The box protruding plate 73 is formed to extend in the vertical direction perpendicularly to the rear frame 101. The box body 71 side edge of the box protruding plate 73 is bent at a 90-degree angle to form a connection allowance 76. The box protruding plate 73 extends to a level lower than the lower end of the electrical box 70 when the electrical box 70 has been assembled to the rear frame 101. That is to say, the vertical dimension of the box protruding plate 73 is longer than the vertical dimension of the electrical box 70.

As shown in FIG. 12, the box protruding plate 73 has a pair of engaging plate portions 73*a*, 73*b* (an example of the engaging portion for assembling) provided thereon that are respectively formed on both end portions in the longitudinal direction of the box protruding plate 73. Each engaging plate portion 73*a*, 73*b* is formed by making a square U-shaped cut in a predetermined portion of the box protruding plate 73 and bending the cut portion to one side in the thickness direction of the box protruding plate 73. That is to say, each engaging plate portion 73*a*, 73*b* is formed by a cutout piece protruding to one side in the thickness direction of the box protruding plate 73.

[Configuration of Frame Protruding Plate]

Figure 13:
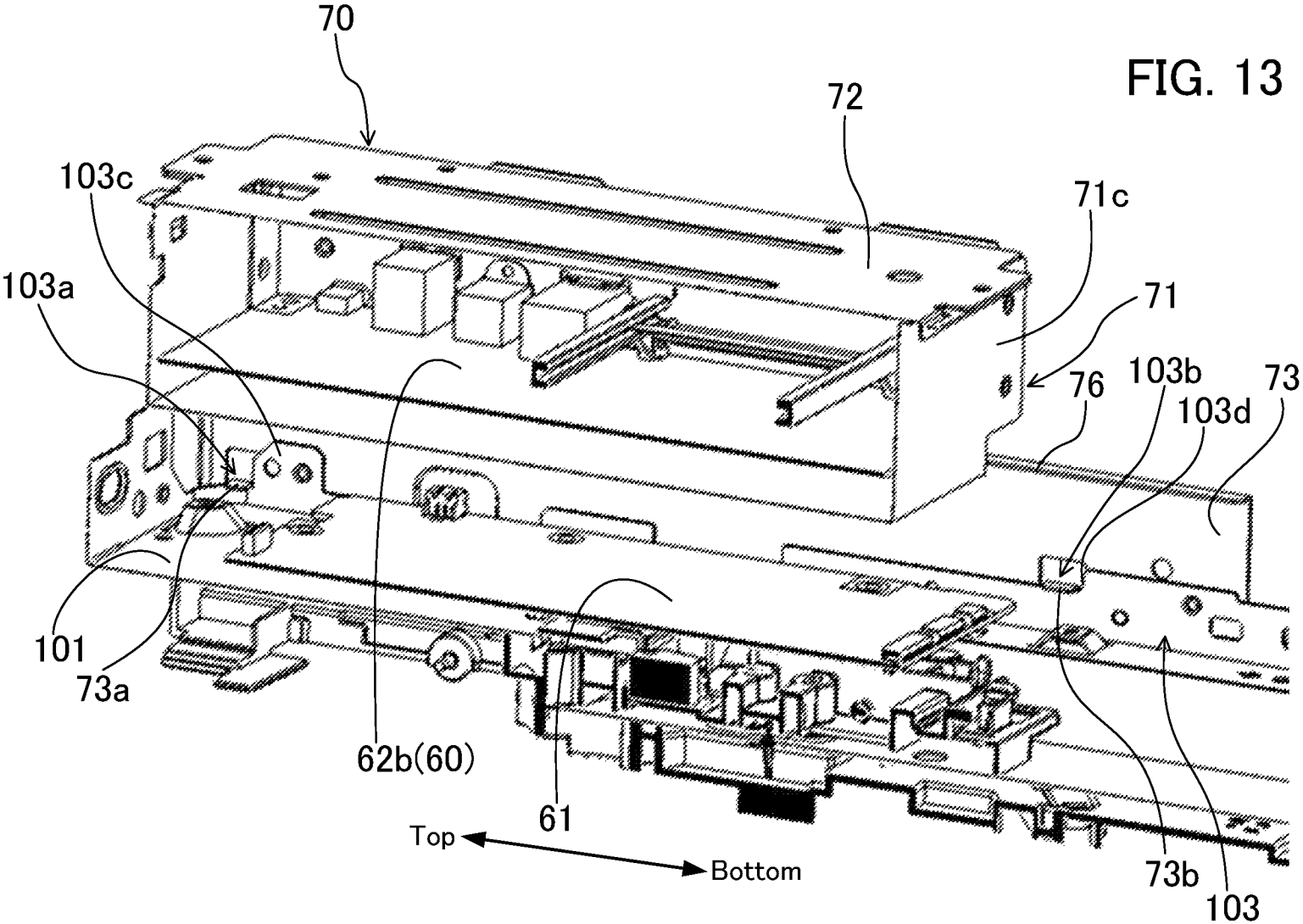
FIG. 13 is a cut model taken along the line XIII-XIII in FIG. 4.

As shown in FIG. 13, the rear frame 101 of the image forming apparatus body 100 has a frame protruding plate 103 formed thereon. The frame protruding plate 103 is positioned at the left end of the rear frame 101 and formed to protrude perpendicularly to the rear frame 101 and extend in the vertical direction.

The frame protruding plate 103 has a pair of engaged portions 103*a*, 103*b* (an example of the first engaged portion) provided at a protruding side end thereof, which engages with the engaging plate portions 73*a*, 73*b* formed on the box protruding plate 73.

The pair of engaged portions 103*a*, 103*b* are formed with a sufficient distance therebetween in the vertical direction. This distance is set to be greater than the vertical dimension of the electrical box 70.

The upper engaged portion 103*a* is adjacent to an upper end surface of a square U-shaped protrusion 103*c* formed at an upper end portion of the frame protruding plate 103, while the lower engaged portion 103*b* is adjacent to an upper end surface of a square U-shaped protrusion 103*d* formed at a lower end portion of the frame protruding plate 103. The square U-shaped protrusions 103*c*, 103*d* adjacent to the engaged portions 103*a*, 103*b* restrict downward movement of the engaging plate portions 73*a*, 73*b*.

[Configuration of Positioning Plate]

Figure 14:
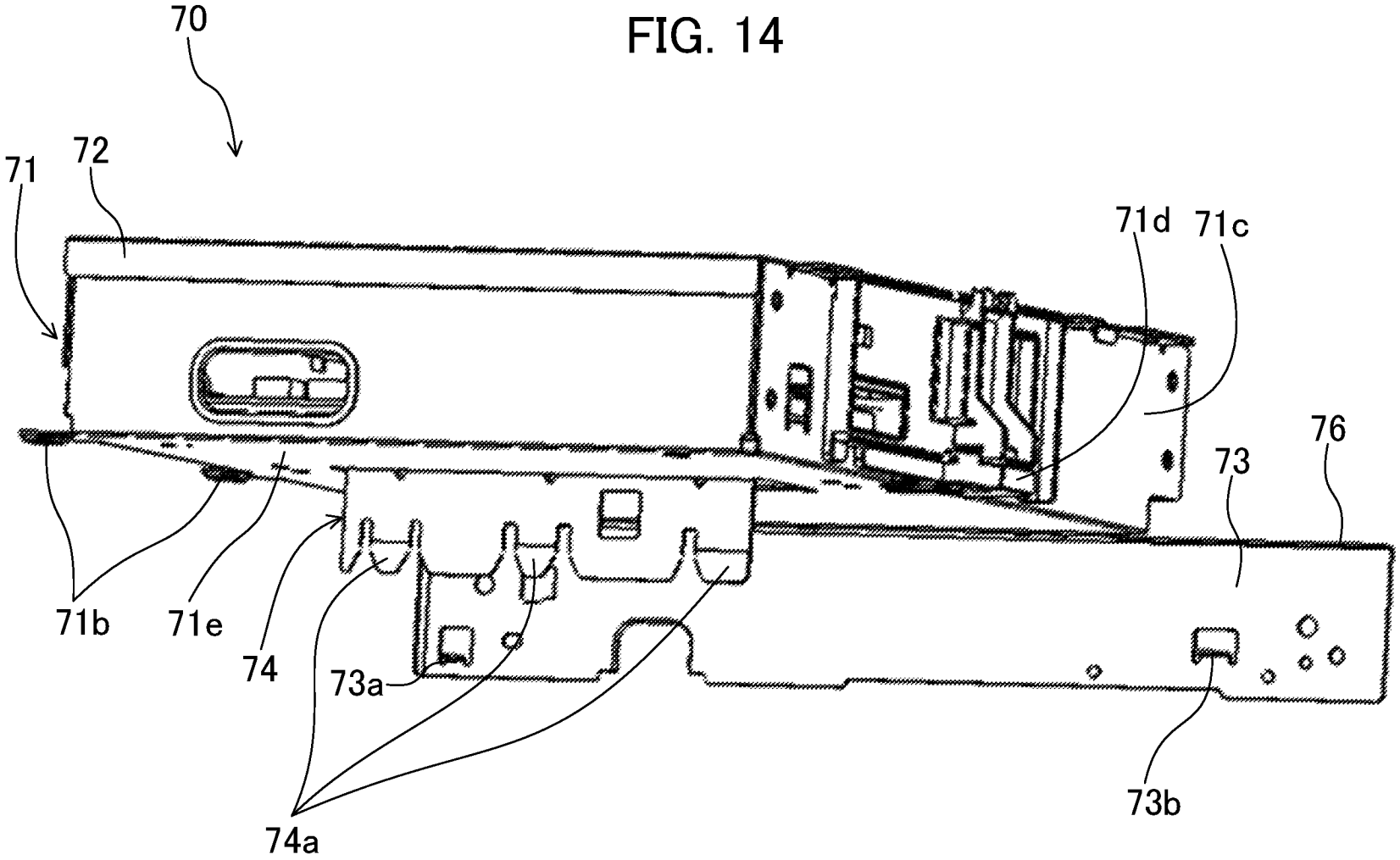
FIG. 14 is a perspective view of the electrical box as viewed from the side facing a box protruding plate.

As shown in FIG. 14, the box body 71 has, in addition to the box protruding plate 73, a box positioning plate 74 provided thereon.

The box positioning plate 74 is formed at an intermediate portion of the base plate 71*e* of the box body 71 in the right-left direction to protrude therefrom and extend in parallel to the box protruding plate.

The box positioning plate 74 has a plurality of (in this embodiment, by way of example, three) engaging protrusions 74*a* (an example of the positioning engaging portion) formed on a protruding side end thereof. The engaging protrusions 74*a* are formed by forming a plurality of slit grooves in the protruding side end of the box positioning plate 74.

Figure 15:
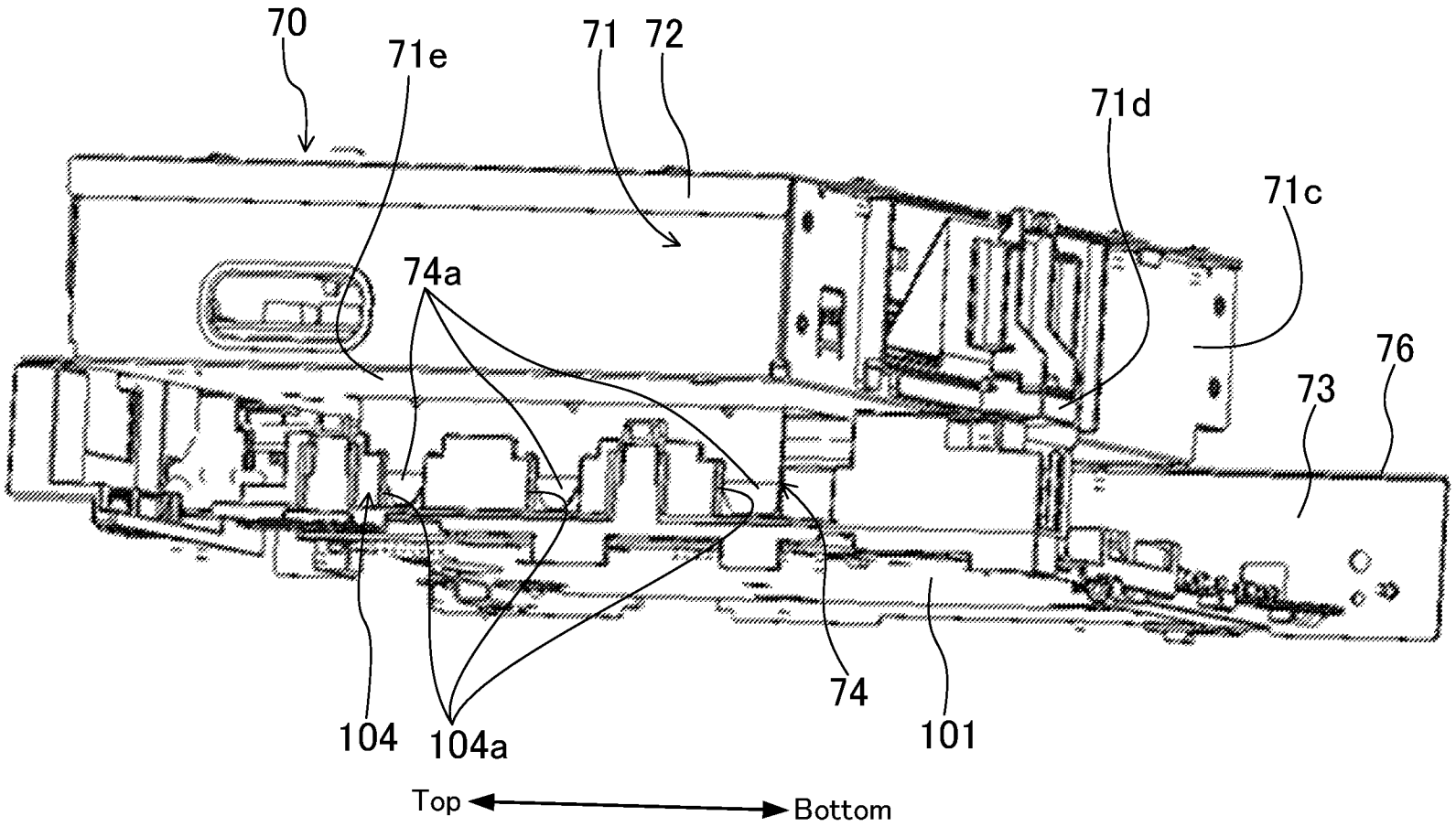
FIG. 15 is a perspective view of the state where the electrical box has been assembled to the rear frame, as viewed from a lateral side.

As shown in FIG. 15, when assembling of the electrical box 70 is completed, the three engaging protrusions 74*a* formed on the box positioning plate 74 engage with cutouts 104*a* (an example of the second engaged portion) of an engaged plate 104 formed on the rear side of the rear frame 101 to stand therefrom. The cutouts 104*a* have a fitting shape fitting with the engaging protrusions 74*a*. The cutouts 104*a* fit (engage) with the engaging protrusions 74*a* to restrict movement of the engaging protrusions 74*a* in the vertical direction.

[Procedure for Assembling Electrical Box to Rear Frame]

Figure 16:
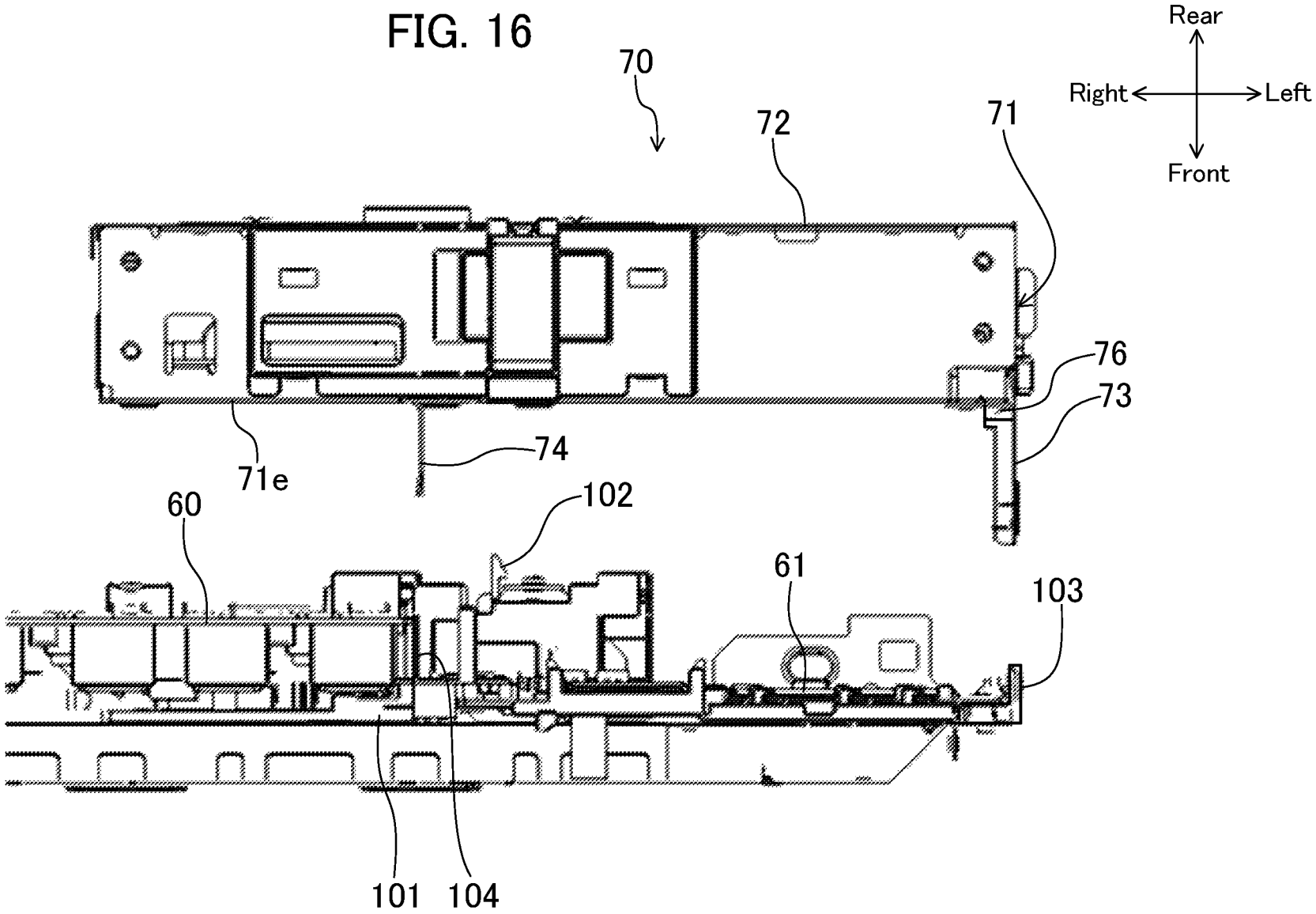
FIG. 16 is an illustration for explaining the first half of a procedure for assembling the electrical box to the rear frame.
Figure 17:
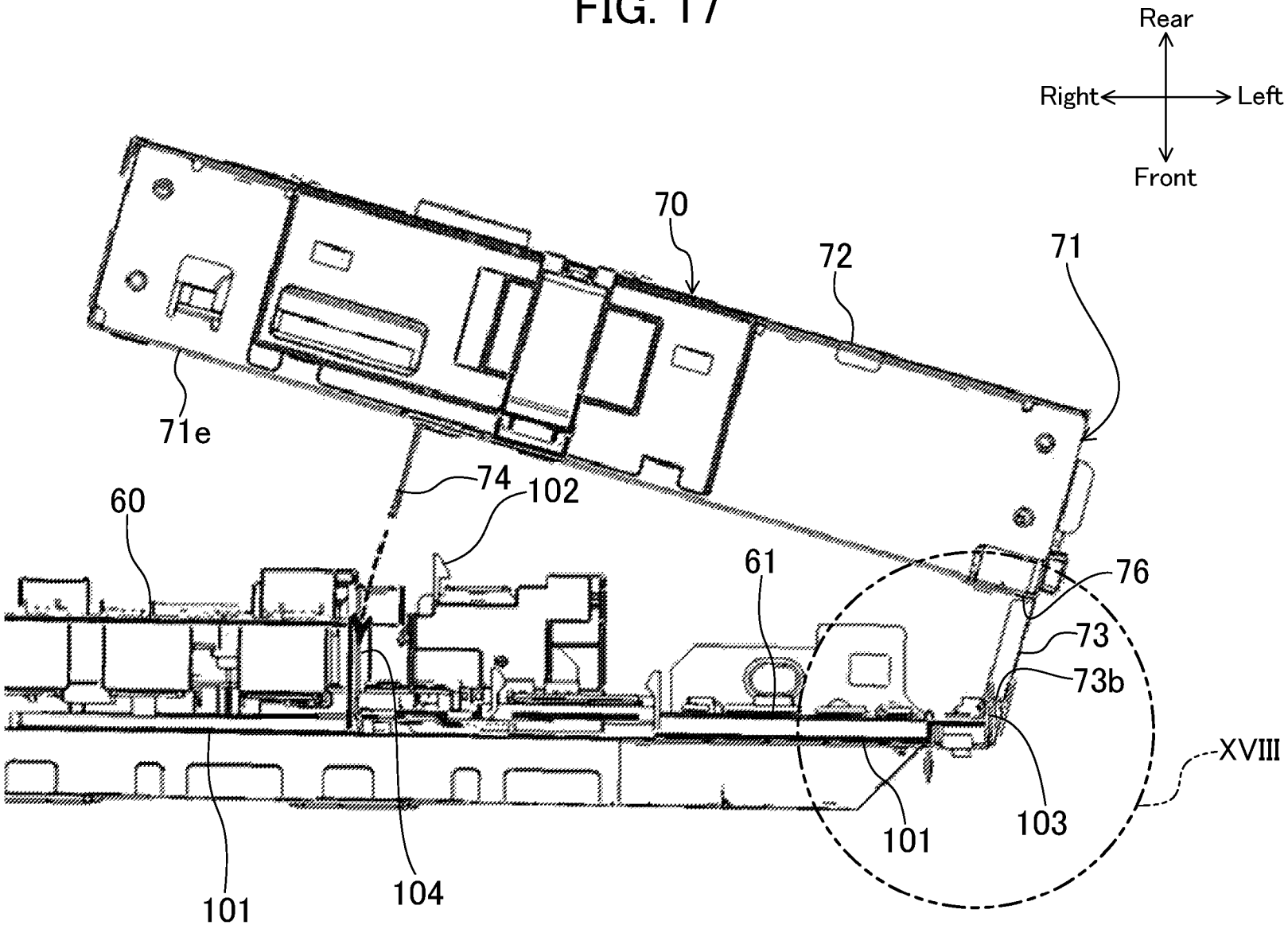
FIG. 17 is an illustration for explaining the latter half of the procedure for assembling the electrical box to the rear frame.
Figure 18:
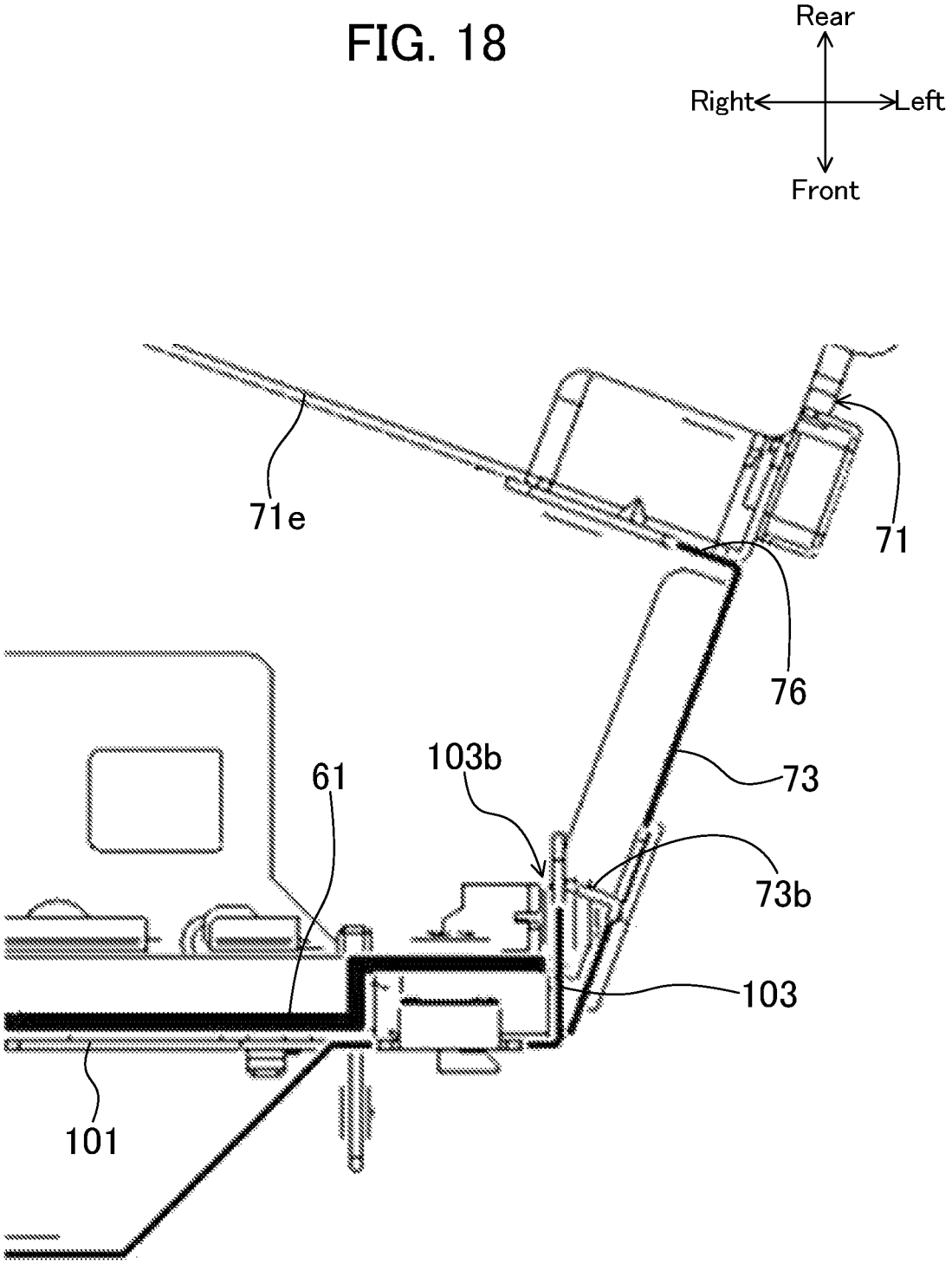
FIG. 18 is an enlarged view of the circled area XVIII in FIG. 17.

Next, a procedure for assembling the electrical box 70 to the rear frame 101 is described with reference to FIGS. 16 to 18. FIGS. 16 and 17 show the positional relation between the electrical box 70 and the rear frame 101 during assembling as viewed from below. FIG. 18 is an enlarged view of the circled area XVIII in FIG. 17.

As shown in FIG. 16, with the electrical box 70 in the vertically standing position, an operator first adjusts the position of the box protruding plate 73 in the right-left direction so that it approximately coincides with the position of the frame protruding plate 103 of the rear frame 101 in the right-left direction.

Substantially, as shown in FIGS. 17 and 18, the operator brings the box protruding plate 73 side of the box body 71 close to the frame protruding plate 103 and inclines the electrical box 70 as a whole toward the mounting surface of the rear frame 101.

Subsequently, the operator brings the pair of engaging plate portions 73*a*, 73*b* (in FIG. 17, only one is shown) formed on the box protruding plate 73 into contact (an example of the engagement) with the pair of engaged portions 103*a*, 103*b*, respectively. This state is not illustrated as a perspective view; however, this state can be easily understood with reference to the illustration in FIG. 13 (the illustration of the state where the assembling has been completed). Thereafter, the operator turns the electrical box 70 as a whole around an axis extending in the vertical direction (an axis extending in the direction perpendicular to the drawing sheet in FIG. 17), with the pair of engaged portions 103*a*, 103*b* as the fulcrum. Once the electrical box 70 is rotated to the position at which the base plate 71*e* of the box body 71 becomes parallel to the rear frame 101, the engaging protrusions 74*a* of the box positioning plate 74 described in relation to FIG. 15 engage the cutouts 104*a* of the engaged plate 104 standing from the rear frame 101, and the engagement hook 102 described in relation to FIG. 8 engages the bracket for fixation 71*b* of the box body 71. Thereby, the electrical box 70 is temporarily held by the rear frame 101, so that the position of the electrical box 70 is maintained even when the operator releases his/her hands from the electrical box 70. After the assembling of the electrical box 70 to the rear frame 101 is completed in this manner, the brackets for fixation 71*b*, 71*d* of the box body 71 (see FIG. 14) are fixed to the rear frame 101 with bolts, whereby fixation of the electrical box 70 to the rear frame 101 is completed.

[Operational Effects]

As described above, in this embodiment, the mounting surface of the rear frame 101 on which the high voltage board 60 and the engine board 61 are mounted has the frame protruding plate 103 provided thereon that is formed perpendicularly to the mounting surface and protrudes outward of the image forming apparatus body 100. The electrical box 70 has the box protruding plate 73 that overlaps the side surface of the frame protruding plate 103 when assembling of the electrical box 70 to the rear frame 101 is completed, and also has the engaging plate portions 73*a*, 73*b* that protrude in the thickness direction from the box protruding plate 73. When the electrical box 70 is assembled to the rear frame 101, the engaging plate portions 73*a*, 73*b* of the box protruding plate 73 are engaged with the engaged portions 103*a*, 103*b* formed on the protruding side end of the frame protruding plate 103, and in this state the electrical box 70 as a whole is turned around an axis parallel to the extending direction of the frame protruding plate 103 (in this embodiment, an axis extending in the vertical direction) with the engaged portions 103*a*, 103*b* as the fulcrum, so that the trajectory of the electrical box 70 during the assembling is restricted.

Therefore, even if the operator's field of view is obstructed by the electrical box 70 when the operator arranges the electrical box 70 over the high voltage board 60 and the engine board 61 after the mounting of the boards 60, 61 onto the rear frame 101, the operator can assemble the electrical box 70 to a predetermined position without the electrical box 70 interfering with the boards 60, 61. Thus, it is possible to prevent the boards 60, 61 from being damaged due to interference with the electrical box 70 during the assembling of the electrical box 70. Further, it is possible to safely assemble the electrical box 70 to the rear frame 101 without depending on the level of the operator's assembling skill.

Further, in this embodiment, the frame protruding plate 103 extends in the vertical direction; therefore, the axis serving as the fulcrum for rotation of the electrical box 70 also extends in the vertical direction. Therefore, the electrical box 70 is less likely to rotate or fall off due to its own weight during the assembling than in the case where the electrical box 70 is rotated around a horizontal axis. This improves the workability in assembling the electrical box 70.

The engaged portions 103*a*, 103*b* of the frame protruding plate 103 are formed at positions adjacent to the upper sides of the square U-shaped protrusions 103*c*, 103*d*, respectively. According to this configuration, downward movement of the engaging plate portions 73*a*, 73*b* of the box protruding plate 73 is restricted when the engaging plate portions 73*a*, 73*b* are in engagement with the engaged portions 103*a*, 103*b*.

This ensures that the electrical box 70 is prevented from falling off due to its own weight when it is rotated with the engaged portions 103*a*, 103*b* as the fulcrum. Therefore, the workability in assembling the electrical box 70 is more improved.

Further, in this embodiment, the box body 71 of the electrical box 70 has the box positioning plate 74 provided thereon that has the engaging protrusions 74*a*. Further, the rear frame 101 has the cutouts 104*a* provided thereon that engage with the engaging protrusions 74*a* of the electrical box 70 when the electrical box 70 as a whole is rotationally moved to (reaches) a predetermined assembling position, thereby restricting downward movement of the engaging protrusions 74*a*.

According to this configuration, the electrical box 70 is prevented from falling off due to its rotation in a plane parallel to the rear frame 101 caused by its own weight.

Further, in this embodiment, the rear frame 101 has the engagement hook 102 formed thereon that protrudes therefrom. The engagement hook 102 engages with the bracket for fixation 71*b* of the box body 71 when the electrical box 70 as a whole is rotationally moved to (reaches) the predetermined assembling position, thereby temporarily holding the electrical box 70 so that the electrical box 70 does not fall down in a direction away from the rear frame 101.

According to this configuration, the electrical box 70 is temporality held by the rear frame 101 without falling down to the operator side (the rear side) even when the operator releases his/her hands from the electrical box 70 after assembling the electrical box 70 to the rear frame 101. Therefore, the operator can move smoothly to the fixation of the electrical box 70 with bolts.

Further, in this embodiment, the control board 62 housed by the electrical box 70 has the connectors 64, 65. Further, the electrical box 70 has the base plate 70*e* and the lid member 72 that are opposed to each other in the direction perpendicular to the rear side of the rear frame 101, and the side plates that stand from the base plate 70*e* and extend to the lid member 72. The upper side plates 71*a* has the opening 70*h* formed therein for exposing the connectors 64, 65 to the outside. The mating connectors (not illustrated) fitting with the connectors 64, 65 are configured to be able to be inserted into and pulled out of the connectors 64, 65 of the control board 62 in the direction perpendicular to the side plate 71*a* through the opening 71*h*.

According to this configuration, the connection and removal of wires to and from the control board 62 can be performed from a lateral side of the electrical box 70. Therefore, for example, when detaching the electrical box 70 from the rear frame 101, the operator does not need bother to remove the lid member 72 to access the connectors 64, 65 inside the box body 71. All the operator needs to do to complete the operation is to remove the bolts 75 (see FIG. 8) fixing the electrical box 70 to the rear frame 101. Therefore, detachment of the electrical box 70 in the event of a fault or for maintenance can be easily performed.

Other Embodiments

The present invention may have the following configurations in relation to the above-described embodiment.

That is to say, in the above-described embodiment, the trajectory of the electrical box 70 is restricted by turning the electrical box 70 around an axis extending in the vertical direction with the engaged portions 103*a*, 103*b* of the frame protruding plate 103 as the fulcrum. However, the present invention is not limited to this configuration and, for example, a configuration is possible in which the frame protruding plate 103 extends in the right-left direction and the electrical box 70 is turned around a horizontal axis.

In the above-described embodiment, the image forming apparatus 1 is a tandem color image forming apparatus. However, the present invention is not limited thereto and the image forming apparatus 1 may be a monochrome image forming apparatus.

Furthermore, the above-described embodiment is described with respect to an example in which the image forming apparatus 1 is a printer. However, the present invention is not limited thereto and the image forming apparatus 1 may be, for example, a copying machine, a facsimile, a multifunction peripheral (MFP), or the like.

INDUSTRIAL APPLICABILITY

As described above, the present invention is useful with an image forming apparatus, and in particular useful for application to a printer, a facsimile, a copying machine, or a multifunction peripheral (MFP).

The invention claimed is:

1. An image forming apparatus, comprising:

an image forming apparatus body housing an image forming unit;

a first electrical board and a second electrical board disposed on a side opposite to the image forming unit side on a frame side plate provided on the image forming apparatus body; and an electrical box housing the second electrical board and arranged to overlap the first electrical board from an outer side of the image forming apparatus body, wherein:

a mounting surface of the frame side plate on which the first electrical board is mounted has provided thereon a frame protruding plate formed perpendicularly to the mounting surface and protruding outward of the image forming apparatus body;

the electrical box has a box protruding plate and an engaging portion for assembling protruding in a thickness direction from the box protruding plate, the box protruding plate overlapping a side surface of the frame protruding plate when assembling of the electrical box to the frame side plate is completed;

the electrical box is configured such that, when the assembling of the electrical box to the frame side plate is carried out, with the engaging portion for assembling in engagement with a first engaged portion formed on a protruding side end of the frame protruding plate, the electrical box as a whole is turned around an axis parallel to an extending direction of the frame protruding plate with the first engaged portion as a fulcrum to thereby restrict a trajectory of the electrical box during the assembling; and the frame protruding plate provided on the frame side plate extends vertically.

2. The image forming apparatus of claim 1, wherein the first engaged portion is formed to restrict downward movement of the engaging portion for assembling when in engagement with the engaging portion for assembling.

3. The image forming apparatus of claim 1, wherein:

the electrical box has a positioning engaging portion; and the frame side plate has provided thereon a second engaged portion configured to, when the electrical box as a whole is turned with the first engaged portion formed on the frame protruding plate as the fulcrum to be positioned at a predetermined assembling position, engage with the positioning engaging portion to restrict downward movement of the positioning engaging portion.

4. The image forming apparatus of claim 1, wherein:

the electrical box has an engaging portion for temporary holding; and the frame side plate has provided thereon an engagement hook configured to, when the electrical box as a whole is turned with the first engaged portion formed on the frame protruding plate as the fulcrum to be positioned at a predetermined assembling position, engage with the engaging portion for temporary holding to temporarily hold the electrical box such that the electrical box does not fall down in a direction away from the frame side plate.

5. The image forming apparatus of claim 1, wherein:

the second electrical board housed by the electrical box has a connector; the electrical box has a base plate and a top plate opposed to each other in a direction perpendicular to the mounting surface of the frame side plate, and a side plate surrounding a space between the base plate and the top plate;

the side plate has an opening formed therein for exposing the connector; and a mating connector fitting with the connector is configured to be able to be inserted into and pulled out of the connector of the second electrical board through the opening in a direction perpendicular to the side plate.

* * * * *